US009009988B2

(12) United States Patent
Jacobs et al.

(10) Patent No.: US 9,009,988 B2
(45) Date of Patent: Apr. 21, 2015

(54) FLEXIBLE SHOE SOLE

(75) Inventors: Laura M. Jacobs, New York, NY (US); Melissa Nataadiningrat, Oakland, NJ (US)

(73) Assignee: Ballet Makers, Inc., Totowa, NJ (US)

( * ) Notice: Subject to any disclaimer, the term of this patent is extended or adjusted under 35 U.S.C. 154(b) by 687 days.

(21) Appl. No.: 13/344,991

(22) Filed: Jan. 6, 2012

(65) Prior Publication Data

US 2013/0174444 A1 Jul. 11, 2013

(51) Int. Cl.

| | |
|---|---|
| ***A43B 5/12*** | (2006.01) |
| ***A43B 13/16*** | (2006.01) |
| ***A43B 7/14*** | (2006.01) |
| ***A43B 13/14*** | (2006.01) |

(52) U.S. Cl.

CPC . *A43B 5/12* (2013.01); *A43B 7/143* (2013.01); *A43B 13/16* (2013.01); *A43B 7/142* (2013.01); *A43B 13/141* (2013.01)

(58) Field of Classification Search

CPC ..... A43B 5/102; A43B 13/141; A43B 13/16; A43B 7/142; A43B 7/143; A43B 7/1485; A43B 5/12

USPC ..... 36/8.3, 102, 25 R, 30 R

See application file for complete search history.

(56) References Cited

U.S. PATENT DOCUMENTS

| | | | | |
|---|---|---|---|---|
| 2,229,406 | A * | 1/1941 | Cutler | 36/59 R |
| 6,076,284 | A | 6/2000 | Terlizzi | |
| 6,412,196 | B1 * | 7/2002 | Gross | 36/102 |
| 7,337,558 | B2 | 3/2008 | Terlizzi et al. | |
| 8,146,272 | B2 * | 4/2012 | Dukovic et al. | 36/59 C |
| 8,333,024 | B2 * | 12/2012 | Fallow et al. | 36/102 |
| 8,356,428 | B2 * | 1/2013 | Auger et al. | 36/102 |
| 8,516,723 | B2 * | 8/2013 | Ferrigan et al. | 36/102 |
| 2002/0017036 | A1 * | 2/2002 | Berger et al. | 36/3 B |
| 2010/0293815 | A1 * | 11/2010 | Ferrigan et al. | 36/25 R |
| 2011/0088287 | A1 * | 4/2011 | Auger et al. | 36/107 |

* cited by examiner

*Primary Examiner* — Ted Kavanaugh

(74) *Attorney, Agent, or Firm* — Laubscher, Spendlove & Laubscher, P.C.

(57) ABSTRACT

A sole for dance footwear such as a dance sneaker includes an outsole having forefoot, arch and heel portions and which contains openings in the forefoot and arch portions. The bottom surface of the outsole further includes a plurality of laterally extending spaced grooves. The grooves and openings provide increased flexure of the outsole from heel to toe and from side to side about a longitudinal axis of the outsole. A shank between the openings in the arch portion of the outsole supports the foot during dance movements, maintains the integrity of the shoe, and improves the aesthetics and ergonomic movement of the footwear.

13 Claims, 3 Drawing Sheets

FLEXIBLE SHOE SOLE

BACKGROUND OF THE INVENTION

A dancer works to create aesthetic lines with his or her whole body. Thus, when a dancer wants to point the foot, to lengthen the line of the leg or if going up on releve or other body movement positions, it is important that the dancer maintain the ability to perform the medium with correct body posture while still achieving the longest, cleanest aesthetic possible.

Until now, most footwear does not fully incorporate all of the ergonomic functions the studio wearer requires. For example, currently available sneakers provide functions that dancers like, but only as a byproduct of the function for which the sneaker was originally designed. For example, a running shoe is able to provide the straight gait user with deep roll through the foot strike. This functionality provides the dancer with an enhanced ability to go into a position like releve or other motions performed on the ball of the foot with enhanced ease, but remains prohibitive to pointing the foot. This is especially noticeable since a running shoe provides more structure to prevent pronation/supination while running, making the shoe further prohibitive to pointing of the foot. Moreover, a running shoe does not have the clean aesthetic that the dancer desires since the break points in the sole used to achieve this level of flexure are deep and visible—even at a distance. The flex afforded by a running shoe is transverse to the longitudinal axis thereof, but the shoe does not afford cupping with a break between the sides. That is, a running shoe is not capable of assuming the concave shape necessary to match a foot in point.

Another shoe which could conceivably be used by dancers is a cross training shoe. While such shoes will provide the user with medial/lateral support which is required by dancers and athletes performing a variety of body motions, when used in a studio setting, they will not provide the user with enhanced roll through. Thus, the dancer must choose stability over flexibility. In addition, the dancer will not have the ability to roll through the foot and onto pointe easily nor can the dancer point his or her foot successfully true to the ergonomic extension of the leg during dance.

Split sole dance shoes are known in the art as evidenced by U.S. Pat. Nos. 6,076,284 and 7,337,558. In such shoes, the soles provide ample flexure in the arch but lack the support of a full soled sneaker and medial/lateral stability during movement. The forepart of the sole operates separately from the heel part, thus leaving room for injury and disconnect for the dancers motion. There is no guided support. Rather, the shoes merely include flexible cushioning. The do not keep the foot in proper alignment, avoid torque, or offer any support when pressure is put on the toe in point formation. The forepart of the sole is often grooved for flexure, but mimics the functionality of a running sneaker as the flexure remains one directional. Split sold jazz shoes provide no arch support and little shock absorption.

The present invention was developed in order to bring functional athleticism particularly into a dance sneaker by providing a dancer with a shoe having adequate flexure and support throughout the length of the shoe. The improved shoe sole flexes to a concave configuration and allows the wearer to remain connected with the floor while providing a full range of motion that does not encumber natural movement of the foot to an on pointe position.

SUMMARY OF THE INVENTION

Accordingly, it is a primary object of the invention to provide a sole for an article of footwear, including by not limited to a dance shoe, which includes an outsole having a generally longitudinal axis extending between toe and heel ends and a generally lateral axis extending between the medial and lateral forefoot across the ball of the foot. The outsole includes a forefoot portion adjacent to the toe end, a heel portion adjacent to the heel end, and an arch portion between the forefoot and heel portions. The outsole contains at least one opening in the arch portion and at least one opening along the longitudinal axis in the forepart portion to increase the flexure of the outsole relative to the axis so that the outsole flexes with the natural concave shape of the forefoot in point formation without torqueing.

According to another embodiment of the invention, the bottom surface of the outsole contains a plurality of spaced laterally extending grooves which increase flexure of the outsole in a direction generally normal to the longitudinal axis. The depth of the grooves vary across the outsole bottom surface, with the depth being greater in the axial region of the base and diminishing in the direction toward the side portions of the outsole.

The outsole further includes a shank in the arch portion which extends along the longitudinal axis to define a pair of openings on opposite sides thereof. The shank provides support to the foot of the wearer in the arch portion. The shank contains a plurality of laterally extending spaced grooves which define lugs which are compressed together in stacked relation when the footwear is cupped from toe to heel during movement of the foot. In addition to the shank, the outsole further includes reinforcing portions between the forefoot and heel portions which are arranged on opposite sides of the pair of openings from the shank in the arch portion. The reinforcing portions do not contain any grooves and provide medial/lateral support to the wearer's foot as well as an improved full sole aesthetic.

In a preferred embodiment, the forefoot portion of the outsole contains a pair of openings which are along the longitudinal axis. Between the openings, the outsole includes at least one bridge portion that extends along the lateral axis. The bridge portion has a thickness which is significantly less than that of the remaining forefoot portion of the outsole and contains a plurality of spaced grooves generally parallel with the axis to increase the flexure of the forepart portion relative to the axis.

The outsole also includes a sidewall portion which extends upwardly from the perimeter of the outsole. The lateral grooves in the bottom surface of the outsole extend into and terminate within the sidewall to provide a clean line and appearance without diminishing the performance of the shoe.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
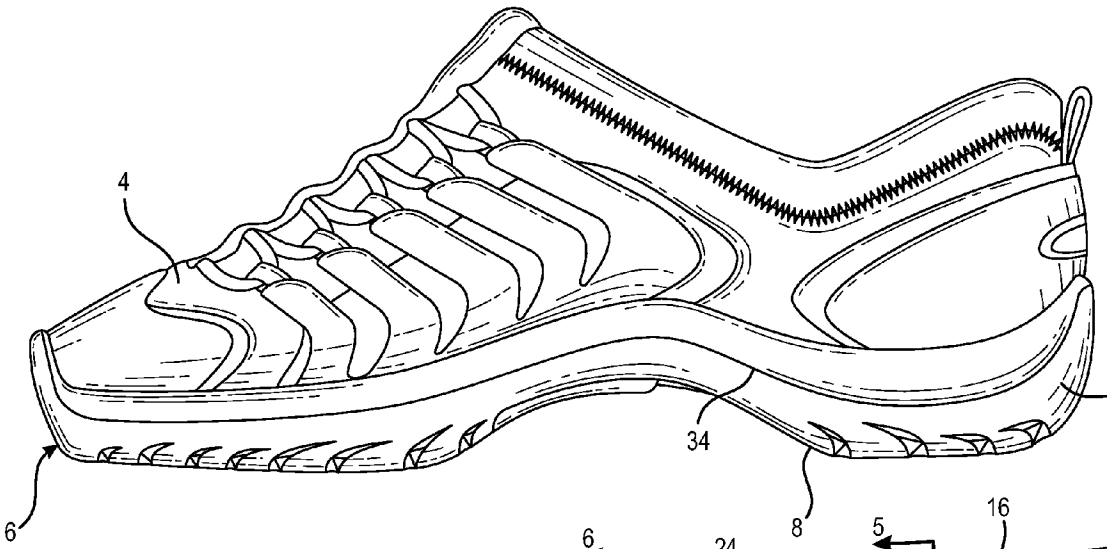
FIG. 1 shows a side plan view of an article of footwear incorporating the flexible outsole according to the invention.

There is shown in FIG. 1 a footwear article in the form of a dance sneaker 2. The sneaker has an upper 4 and a sole 6 connected with the lower portion of the upper. The upper is typically formed of canvas, stretch material such as nylon, spandex, mesh, foam, thermoplastic polyurethane (TPU), suede, leather, or other lightweight, dynamic, and durable fabric. The sole may comprise a plurality of layers such as a midsole (not shown) and an outsole 8 as is known in the art.

The invention relates to an improved outsole 8 which will be described with reference to FIGS. 2-6. The outsole and midsole are formed of a durable, flexible material such as TPU, polyurethane (PU), synthetic rubber, suede, microfiber, ethyl vinyl acetate (EVA), and leather. The outsole and midsole can be formed of a single material or a combination of materials and may have different durometers.

Figure 2:
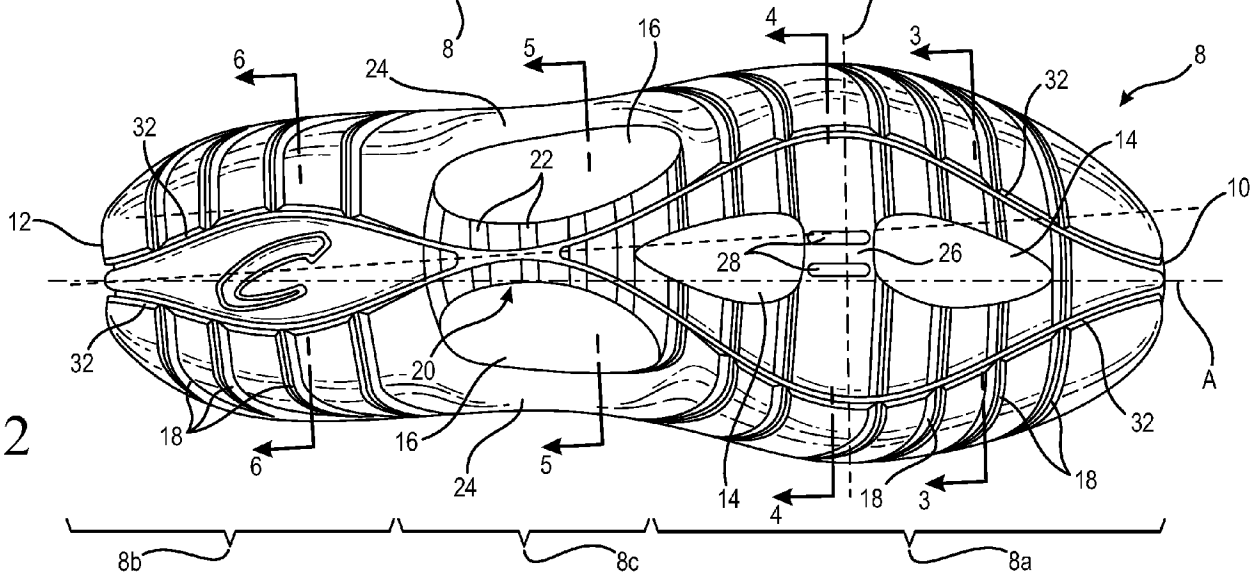
FIG. 2 is a bottom plan view of the outsole according to the invention.
Figure 3:
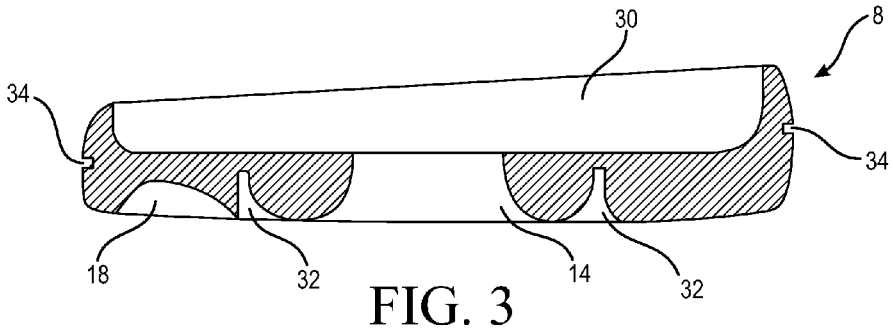
FIGS. 3-6 are sectional views taken along lines 3-3, 4-4, 5-5, and 6-6, respectively, of FIG. 2.

Referring now to FIG. 2, the outsole 8 has a toe end 10 and a heel end 12, a longitudinal axis A that extends between the toe and heel ends. The outsole contains a forefoot portion 8*a* adjacent to the toe end 10, a heel portion 8*b* adjacent to the heel end 12 and an arch portion 8*c* between the forepart and heel portions. A lateral axis B extends between the medial lateral portion of the outsole through the forefoot portion beneath the ball region of the foot. The forefoot portion contains at least one void or opening 14 which is centrally arranged along the longitudinal axis. In the preferred embodiment shown in FIG. 2, two spaced openings 14 are provided in the forefoot portion. The openings may have any configuration. In the embodiment shown, the openings are elongated along the longitudinal axis. In addition to the forefoot openings, two openings 16 are also provided in the arch portion 8*c* of the outsole. The arch openings are laterally spaced and are also elongated in a direction generally parallel to the longitudinal axis. The openings may be in the form of cavities defined by the removal of material from the lower surface of the outsole, but not extending completely through the outsole. In a preferred embodiment, however, the openings are through openings which extend completely through the outsole and through the midsole if a midsole is provided. When applied to the article of footwear shown in FIG. 1, the footbed, lining, or upper of the shoe would thus be exposed by the through openings.

The voids or openings 14, 16 in the outsole reduce the material of the outsole in specific areas in order to increase the flexure of the outsole relative to the axis. That is, the outsole of the invention is able to flex inwardly in a concave or cupping configuration so that the sides of the outsole can be brought together. This is advantageous during dance and other types of body movements. During motion, the forefoot actually expands while standing flat or when any type of pressure is applied to the foot. During extension onto the ball of the foot and through the toes, the foot can either expand or retract depending on the type of flexure. A full pointed dance position creates a much shorter foot and the foot actually contracts with a cupping motion under the ball of the foot so that the foot shortens in length and width.

The outsole is constructed in an ergonomic fashion and the removal of material from the outsole and midsole in the areas of the openings 14, 16 allows the wearer to point or flex the shoe with enhanced ease. This is because the resistance of the outsole is decreased in the vicinity of the openings. The openings in the forefoot portion of the outsole are placed underneath the metatarsals and extend toward the arch and toes to mimic the void locations that the foot creates when pointed. Similarly, the openings in the arch portion perform the same function and allow enhanced aesthetic and point articulation.

In addition to increased flexure along the axis of the outsole, the outsole is also provided with a plurality of spaced laterally extending grooves 18 in the bottom surface which increase flexure of the outsole between the toe 10 and heel 12 ends. The grooves are spaced throughout the forefoot and heel portions to improve the performance of the outsole. The grooves are slanted and the depth of the grooves is greater in the axial region of the outsole than toward the sides. If a midsole is provided, the grooves may extend through the outsole into the midsole. However, the grooves do not extend completely through the sole of the shoe. The grooves afford a full range of motion but hide the functionality so that the dancer can maintain clean leg lines and a clean aesthetic to enhance the dancing experience.

Figure 5:
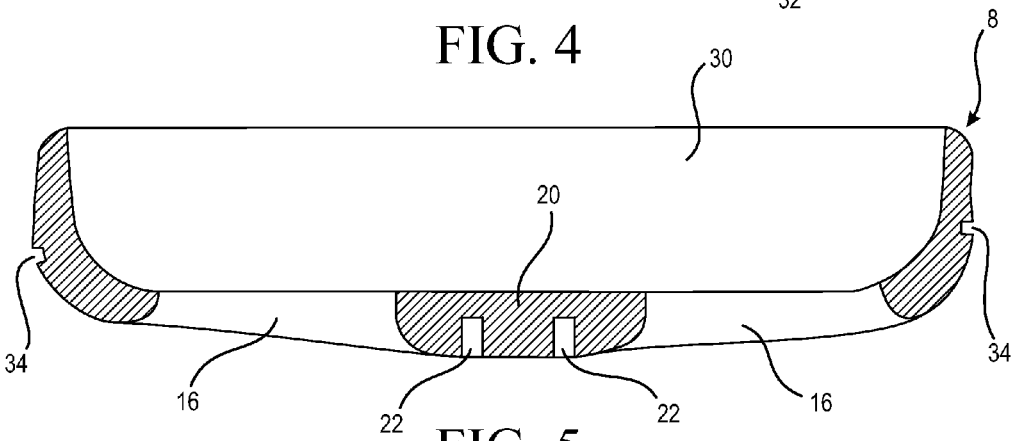
Figure 6:
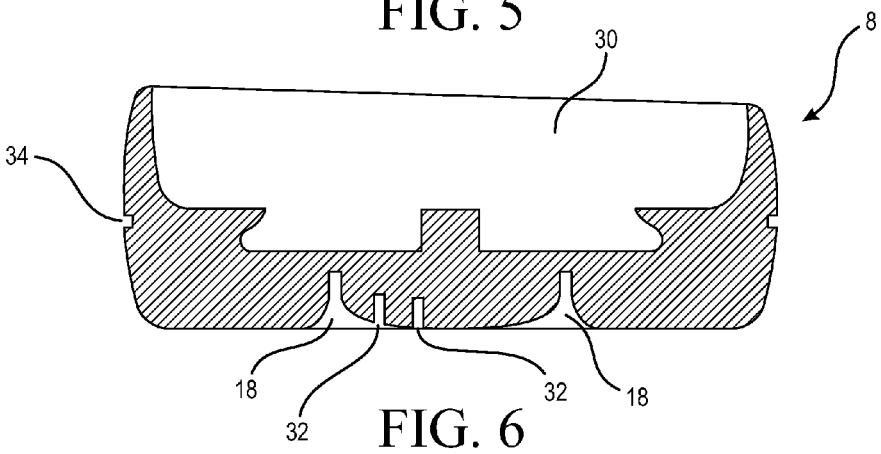

As shown in FIGS. 2 and 5, the outsole 8 according to the invention includes a shank 20 in the arch portion. The shank is arranged between the openings 16 and contains a plurality of spaced grooves 22 which define lugs which are compressed together in stacked relation when the dance shoe is cupped from toe to heel such as when the dancer rises up on the toes in an on pointe position. The shank performs several functions. While standing flat, the shank provides the support of a full soled sneaker and it maintains the structural integrity of the shoe by preventing the voids created in the forefoot portion from bowing or stretching out. It also provides an enhanced aesthetic when viewed from the side because the shank stays tucked up within the arch of the foot. While the foot moves from releve into pointe during dance, the arch compresses and the stacked lugs within the shank support the foot in the same manner as in a pointe shoe. The shank further connects the forefoot and heel portions of the outsole to prevent disconnect therebetween. While the shank is shown as a portion of the arch portion 8*c* of the outsole, it will be understood that it can also be provided in the midsole if desired. Moreover, while the shank is illustrated as being an integral portion of the outsole, it may be formed as a separate element of synthetic plastic or carbon fiber and then connected with the outsole or midsole. In addition, a plurality of shanks may be provided in lieu of a single shank.

Figure 7:
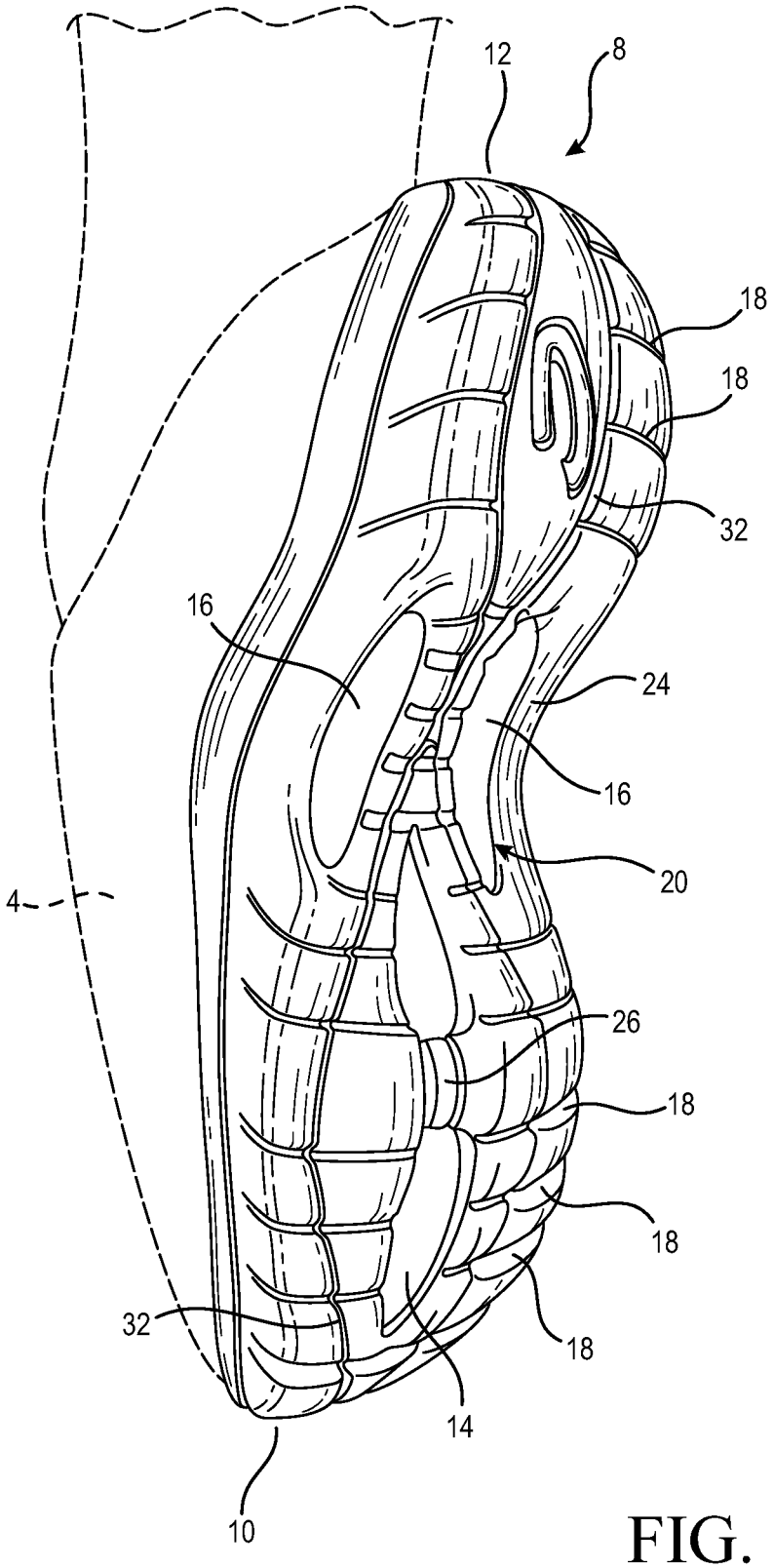
FIG. 7 is a perspective view of a the outsole of FIG. 1 in a pointe position.

In order to enhance the medial/lateral support for the foot, create a full soled aesthetic, and provide additional support to the shank 20, the outsole 8 further includes reinforcing bars 24 in the arch portion 8*c*. The reinforcing bars are arranged on the outer sides of the openings 16 opposite the shank 20 as shown in FIG. 2. The reinforcing bars need not contain grooves, although grooves may be provided to increase flexure or alter the look of the shoe. They help keep the feet straight rather than pronate or supronate. In addition, when the dancer goes on pointe or releve, the reinforcing bars push upwardly and help keep the foot supported not only in the arch but along both sides of the foot. FIG. 7 shows the outsole according to the invention with the The bars bend with the full range of motion, offer support, and correct movements in an ergonomically advantageous way. They are preferably formed of the same material as the outsole or midsole.

Figure 4:
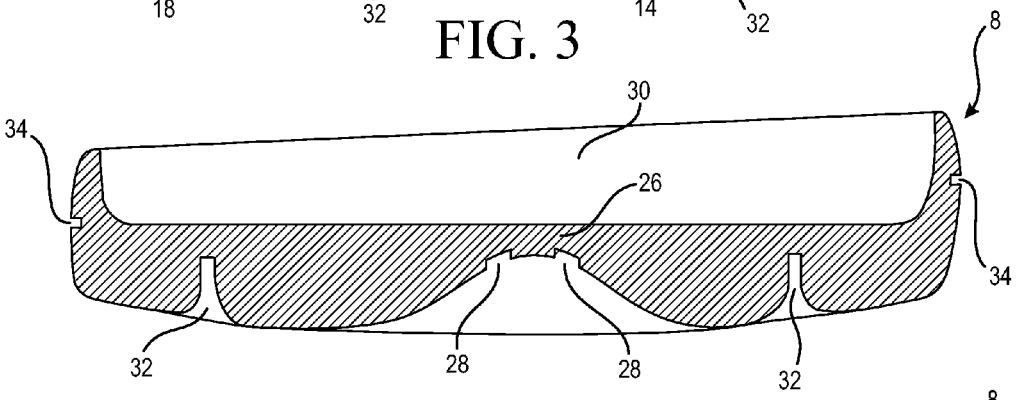

Referring once again to FIG. 2, the forefoot portion 8*a* of the outsole further contains at least one bridge portion 26 extending along the lateral axis B between the openings 14. The bridge portion has a thickness which is less than the depth of the remaining portion of the forefoot portion as shown in FIG. 4. In addition, the bridge portion contains a plurality of spaced grooves 28 extending generally parallel to the longitudinal axis of the outsole. The reduced thickness of the bridge portion and the grooves 28 increase the flexure of the outsole forefoot portion to facilitate bending of the outsole along the longitudinal axis. A plurality of bridge portions may be provided. A bridge may also be provided in the midsole in the absence of an outsole. The bridge portion may be formed from the same material as the outsole or a different material such as synthetic plastic or carbon fiber.

At the perimeter of the outsole is provided an upstanding sidewall 30 which may be integrally formed with the outsole. The sidewall is formed of one of the materials used to form the outsole. The lateral grooves 18 in the bottom surface of the outsole preferably extend into and terminate within the sidewall.

The outsole includes additional grooves 32 in the bottom surface to subdivide the forefoot and heel portions 8*a*, 8*b* into further regions and a groove 34 between the outsole and side wall. This facilitates forming the different regions of the outsole with materials of different density to enhance the overall performance of the shoe. For example, it may be desirable to provide those portions of the outsole which come into the most contact with the floor with a higher density than the remaining portions of the outsole.

FIG. 7 shows the configuration of the outsole 8 when the dancer is in the on pointe position. The vamp 4 and leg of the dancer are shown in phantom. The outsole is cupped within the arch portion from heel to toe and curved inwardly about the longitudinal axis. The shank is partially collapsed within the arch portion.

While the preferred forms and embodiments of the invention have been illustrated and described, it will be apparent to those of ordinary skill in the art that various changes and modifications may be made without deviating from the inventive concepts set forth above.

What is claimed is:

1. A sole for an article of footwear, comprising an outsole having, a longitudinal axis extending between a toe end and a heel end, said outsole containing (a) a plurality of spaced laterally extending grooves in a lower surface thereof for increasing flexure of the outsole in a direction generally normal to said axis, a depth of the grooves being greater in an axial region of said outsole and said depth diminishing in a direction toward side portions of said outsole;

(b) a forefoot portion adjacent to said toe end;

(c) a heel portion adjacent to said heel end; and (d) an arch portion between said forefoot and heel portions, said forefoot portion containing at least one opening and said arch portion containing at least one opening, said openings increasing the flexure of the outsole relative to said axis, whereby when the footwear is worn, said outsole flexes with the foot during movement of the foot.

2. A sole for an article of footwear, comprising an outsole having, a longitudinal axis extending between a toe end and a heel end, said outsole containing (a) a plurality of spaced laterally extending grooves in a lower surface thereof for increasing flexure of the outsole in a direction generally normal to said axis;

(b) a forefoot portion adjacent to said toe end;

(c) a heel portion adjacent to said heel end; and (d) an arch portion between said forefoot and heel portions, said arch portion including at least one shank, said forefoot portion containing at least one opening and said arch portion containing at least opening, said forefoot and arch openings increasing the flexure of the outsole relative to said axis, whereby when the footwear is worn, said outsole flexes with the foot during movement of the foot and said shank supports the foot in said arch portion.

3. A sole as defined in claim 2, wherein said shank contains a plurality of spaced laterally extending grooves which define lugs which are compressed together in stacked relation when said footwear is cupped from toe to heel during movement of the foot.

4. A sole as defined in claim 2, wherein said outsole includes reinforcing portions in said arch portion, said reinforcing portions being arranged between said forefoot and heel portions and on opposite sides of said pair of arch portion openings from said shank.

5. A sole as defined in claim 4, wherein said reinforcing portions are free of grooves.

6. A sole as defined in claim 4, wherein said forefoot portion contains a pair of longitudinally spaced openings.

7. A sole as defined in claim 6, wherein said forefoot portion of said outsole contains at least one bridge portion between said pair of openings, said bridge portion having a thickness which is less than the thickness of a remaining portion of said forefoot portion.

8. A sole as defined in claim 7, wherein said bridge portion contains a plurality of spaced grooves extending generally parallel to said longitudinal axis to increase the flexure of said outsole forefoot portion relative to said longitudinal axis for lateral cupping of said outsole.

9. A sole as defined in claim 7, and further comprising a sidewall extending upwardly from a perimeter of said outsole, said laterally extending grooves extending into and terminating within said sidewall.

10. A sole as defined in claim 9, wherein said outsole is formed of one of thermoplastic polyurethane, polyurethane, synthetic rubber, ethyl vinyl acetate, microfiber, suede and leather.

11. A sole as defined in claim 10, wherein said forefoot and heel portions of said outsole are formed of a material having a density which differs from the density of the remaining portions of said outsole.

12. A sole as defined in claim 11, wherein said outsole lower surface contains further grooves defining said portions of differing density.

13. A sole as defined in claim 2, wherein said forefoot and arch openings are through openings.

* * * * *